US007699758B1

(12) United States Patent
Hoggan et al.

(10) Patent No.: US 7,699,758 B1
(45) Date of Patent: Apr. 20, 2010

(54) BI-DIRECTIONAL EXERCISE MACHINE WITH DIFFERENT RESISTANCES IN DIFFERENT DIRECTIONS

(75) Inventors: Lynn D. Hoggan, Sandy, UT (US); James R. Richards, Farmington, UT (US); Michael K. Durtschi, Sandy, UT (US)

(73) Assignee: Hoggan Health Industries, Inc., West Jordan, UT (US)

( * ) Notice: Subject to any disclaimer, the term of this patent is extended or adjusted under 35 U.S.C. 154(b) by 1366 days.

(21) Appl. No.: 11/064,051

(22) Filed: Feb. 22, 2005

(51) Int. Cl.
*A63B 21/00* (2006.01)

(52) U.S. Cl. ..... 482/51; 482/72; 601/34

(58) Field of Classification Search ..... 482/6, 482/7, 2

See application file for complete search history.

(56) References Cited

U.S. PATENT DOCUMENTS

| | | | | |
|---|---|---|---|---|
| 4,691,694 | A * | 9/1987 | Boyd et al. | 601/34 |
| 4,726,582 | A | 2/1988 | Fulks | |
| 5,254,061 | A | 10/1993 | Leask | |
| 6,533,709 | B1 | 3/2003 | Jones | |
| 6,679,812 | B2 | 1/2004 | Torkelson | |
| 6,736,766 | B1 | 5/2004 | Gallant | |
| 6,790,162 | B1 | 9/2004 | Ellis et al. | |

* cited by examiner

*Primary Examiner*—Jerome Donnelly
(74) *Attorney, Agent, or Firm*—Thorpe North & Western LLP

(57) ABSTRACT

An exercise apparatus includes a frame and handles mounted on the frame and moveable by a user in opposite directions. The handles are coupled to a transmission so that movement of the handles by a user create rotational movement of a transmission input, movement of the handles in one direction creating rotational movement of the transmission input in one direction and movement of the handles in the opposite direction creating rotational movement of the transmission input in the opposite direction. The transmission couples the transmission input to a resistance means, such as an eddy current resistance device, in a manner to provide a different resistance to rotation of the transmission input depending upon the direction of rotation of the transmission input. Thus, the resistance to rotational movement of the transmission input in one rotational direction is greater than it is in the opposite rotational direction. This coupling can be accomplished by converting rotational movement of the transmission input in opposite directions into an output having only one direction of rotation and coupling the output to a single resistance element, or the transmission can couple a shaft that rotates in opposite directions to two resistance elements so that rotation in one direction is resisted by one resistance element and rotation in the opposite direction is resisted by the other resistance element.

25 Claims, 7 Drawing Sheets

Figure 1:
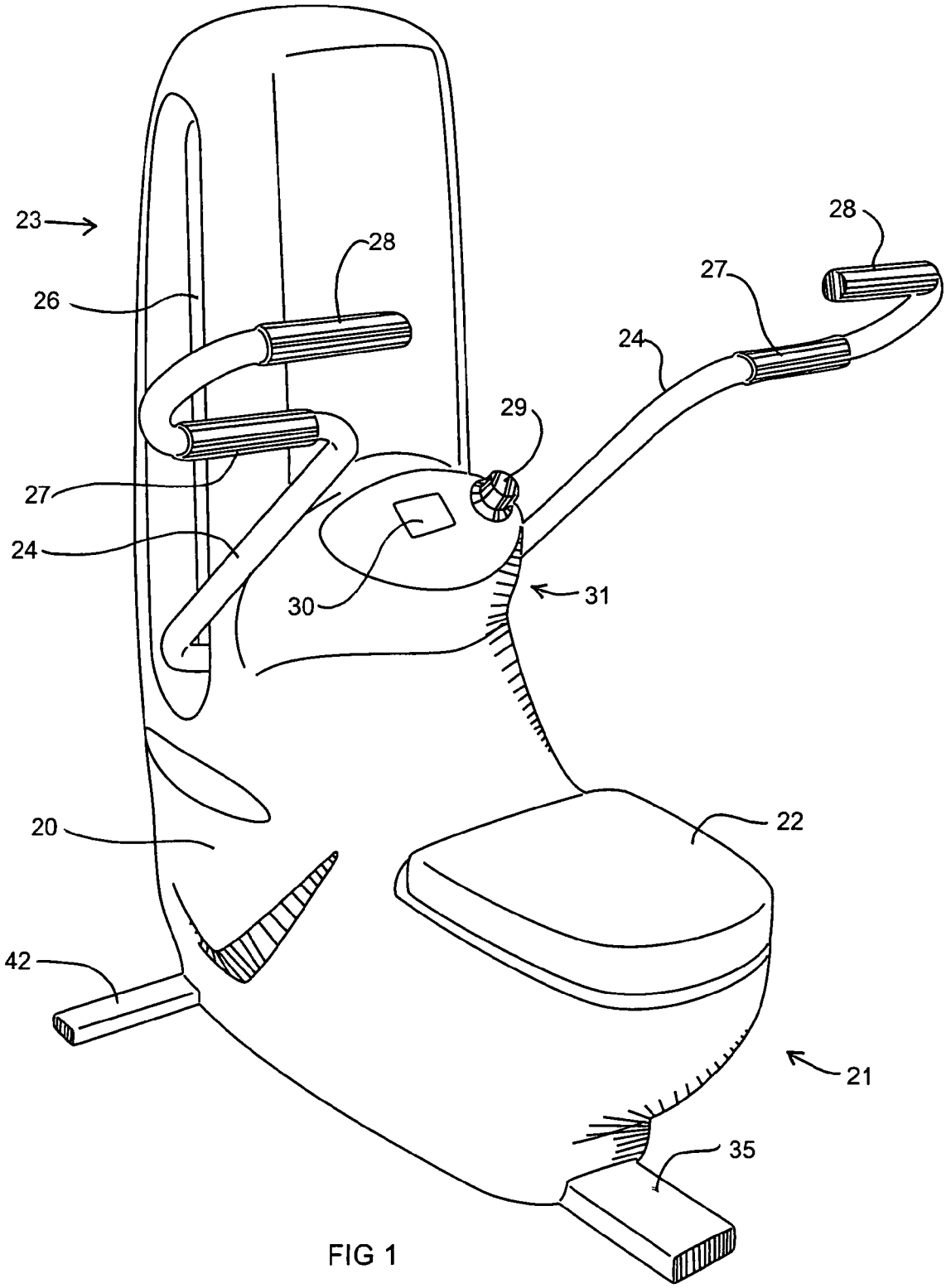

BI-DIRECTIONAL EXERCISE MACHINE WITH DIFFERENT RESISTANCES IN DIFFERENT DIRECTIONS

BACKGROUND OF THE INVENTION

1. Field

The invention is in the field of exercise machines that provide two directions of resistance to movement of a user.

2. State of the Art

There are numerous exercise machines that provide handles to a user that are moved by the user in opposite, back and forth directions and which provide resistance to movement that the user overcomes in moving the handles to thus exercise parts of the user's body. Many of these devices provide for adjustment of the resistance to movement offered by the handles. In this way, a user can adjust the amount of resistance to adjust the exercise provided by moving the handles. Some of these exercise devices provide the resistance to movement in both directions of movement while other such devices provide resistance in only one or the other of the directions of movement. U.S. Pat. No. 6,736,766 provides an exercise apparatus wherein the user can not only adjust the amount of resistance to movement, but can also adjust whether the resistance is applied in only one or the other direction of movement or in both directions of movement. However, when adjusted to provide resistance in both directions of movement, the adjusted resistance is the same in both directions.

It is seldom that a user of exercise equipment will be able to move a handle in each of opposite directions with equal strength. For example, if a user is performing a shoulder press to lift handles upwardly against a resistance, and then is performing a lat pull to pull the handles downwardly against a resistance, the user will normally be able to pull downwardly with greater strength than the user can push upwardly. Thus, to exercise effectively, the user will want more resistance to downward pull than to upward push. With current exercise equipment, a user will generally perform shoulder presses separately from performing lat pulls. The equipment used for shoulder presses will generally provide resistance to upward movement of the handles and provide no resistance to the downward return movement after the shoulder press is completed. The user thus performs a repetition of shoulder presses. The user would then either move to a separate piece of equipment to perform lat pulls or have to adjust the equipment used for shoulder presses to change the mode of operation to perform lat pulls. The equipment would then allow unresisted upward movement of the handles and would be adjusted to provide the desired resistance to the downward lat pull. The user would then perform a repetition of lat pulls. Some current machines can provide resistance in both directions of handle travel, however, the resistance provided in each of the opposite directions is equal. Thus, the user would adjust the resistance to the desired resistance for performing the shoulder presses and this would then also be the resistance provided by the machine for lat pulls. However, since the user generally would need increased resistance for the lat pulls to adequately exercise the muscles involved, the resistance provided for the lat pulls would not provide the degree of exercise generally desired by the user.

It would be desirable to have an exercise machine that would provide a different desired resistance in each direction of handle movement, thus allowing the shoulder presses to be performed with the upward arm movement at one resistance setting and the lat pulls to be performed with the downward arm movement at a second resistance setting. The same need for different resistance settings for different directions of handle movement is present with most exercises. For further example, different resistances for different directions of handle movement would be desirable for machines on which a user can perform both chest presses and horizontal rowing, both biceps curls and triceps presses, both abdominal flexion and back extensions, leg extensions and leg curls, and total leg presses.

SUMMARY OF THE INVENTION

According to the invention, exercise apparatus provides handles to be moved by a user against resistance to movement, and a different resistance is provided to movement of the handles in one direction and to movement of the handles in the opposite direction. Such exercise apparatus includes a frame and handles mounted on the frame and moveable by a user in opposite directions. The handles are coupled to a transmission so that movement of the handles by a user creates rotational movement of a transmission input, movement of the handles in one direction creating rotational movement of the transmission input in one direction and movement of the handles in the opposite direction creating rotational movement of the transmission input in the opposite direction. The transmission couples the transmission input to a resistance means, such as an eddy current resistance device, in a manner to provide a different resistance to rotation of the transmission input depending upon the direction of rotation of the transmission input. Thus, the resistance to rotational movement of the transmission input in one rotational direction is greater than it is in the opposite rotational direction. This coupling can be accomplished by converting rotational movement of the transmission input in opposite directions into an output having only one direction of rotation, the transmission ratio coupling the transmission input to the transmission output being different for each direction of rotation of the transmission input, and coupling the output to a single resistance element, or the transmission can couple a shaft that rotates in opposite directions to two resistance elements so that rotation in one direction is resisted by one resistance element and rotation in the opposite direction is resisted by the other resistance element. In such instance, each resistance element provides a different resistance to rotation.

The resistance element is preferably an eddy current generation device having a disc that rotates between magnets, the positioning of the magnets in relation to the disc determining the resistance to rotation developed by the disc. Where the transmission output rotates in a single direction, a single disc is coupled to the transmission output to be rotated by the transmission. Where the transmission output changes direction of rotation, two discs are coupled to the transmission so that one disc is rotated when the transmission input rotates in one direction and the other disk is rotated when the transmission input is rotated in the opposite direction. In each situation, the position of the magnets with respect to the disc can be adjusted to adjust the resistance to rotation generated by the disc. When two discs are used, the relative positioning of the magnets for the respective discs is preferably preset and stays the same with the positions of the magnets being simultaneously adjusted to maintain the same relative positions and the same ratio of resistances to rotation. However, the magnets could be separately adjustable to separately adjust the resistance to rotation of each disc and thereby adjust not only the resistance to rotation in each direction, but also the ratio of the differences in the resistances generated by each disc.

THE DRAWINGS

Figure 2:
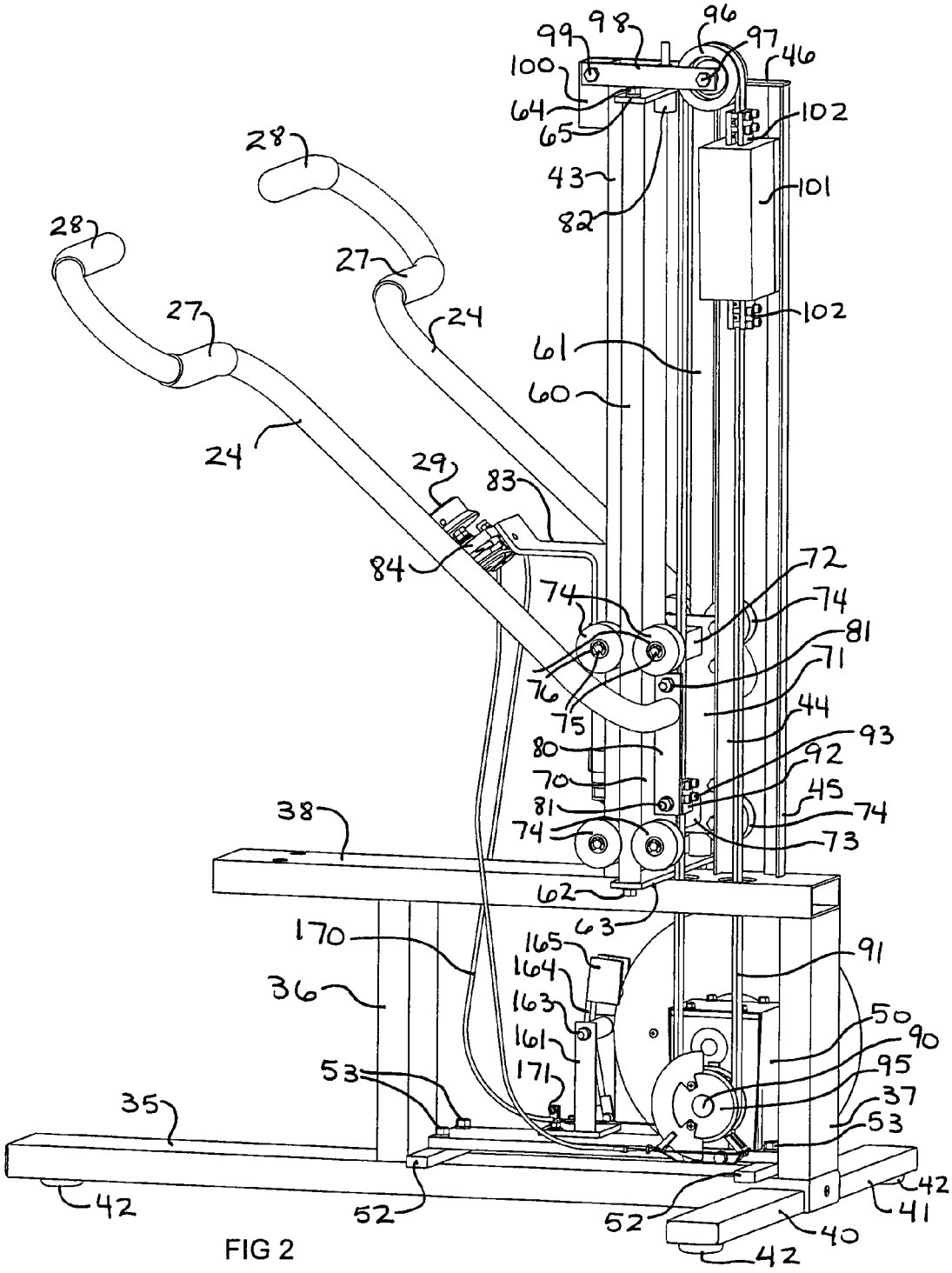
Figure 3:
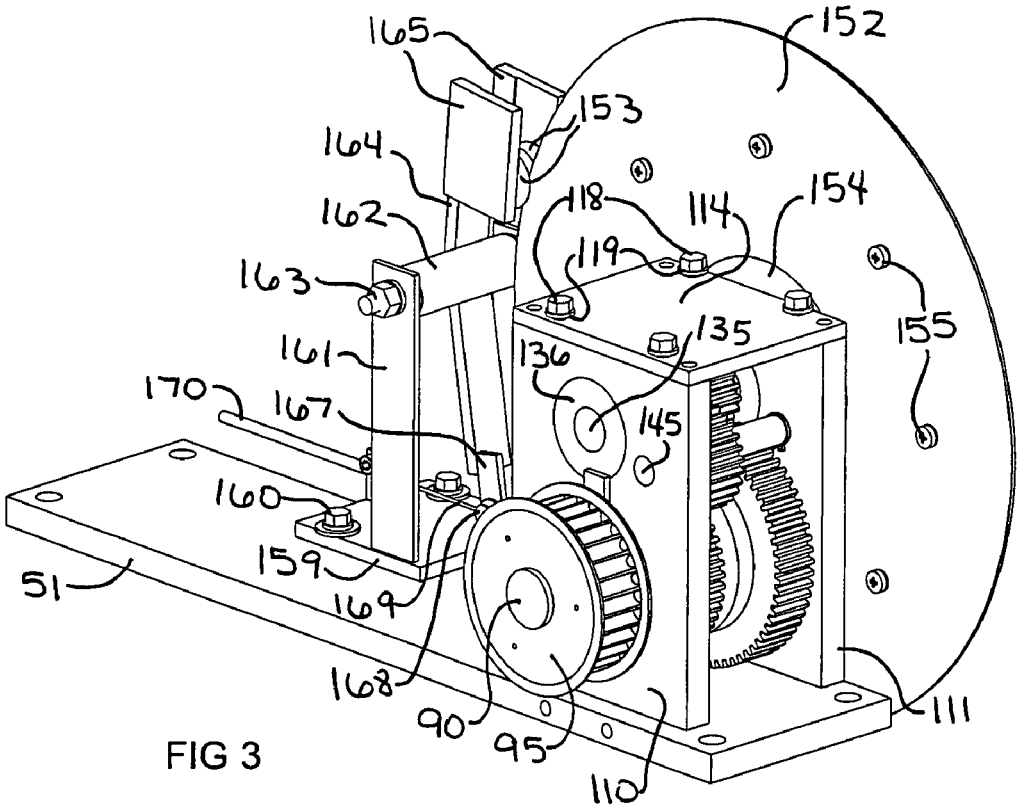
Figure 4:
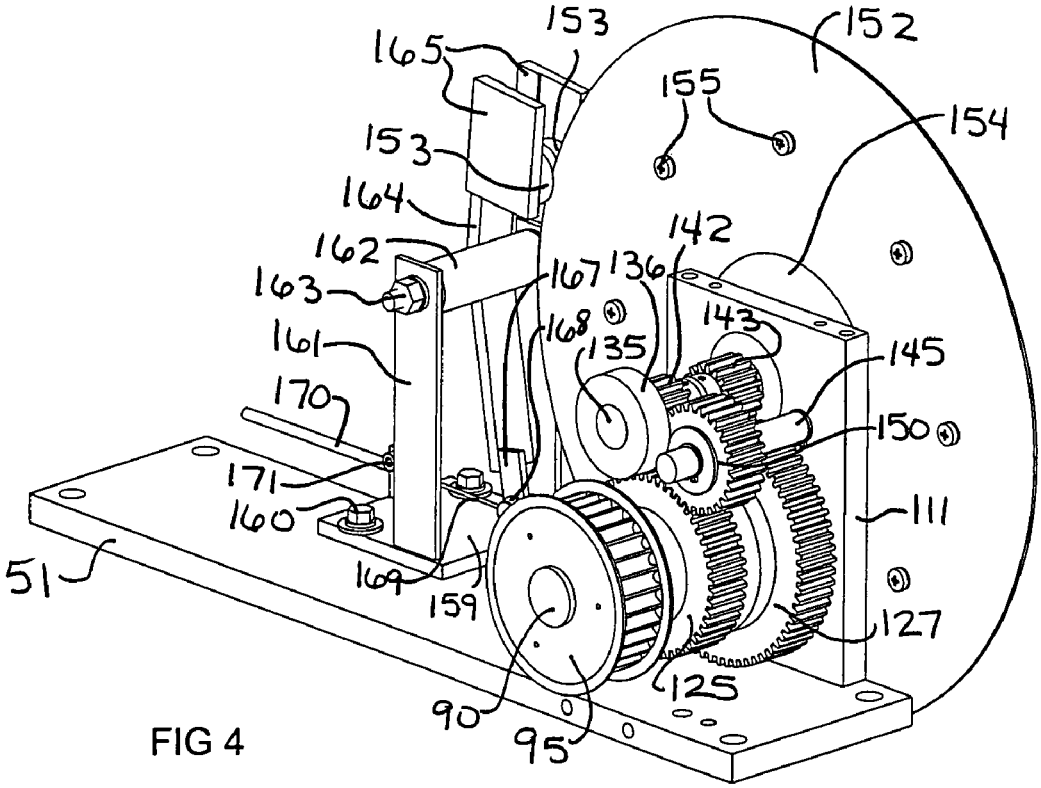
Figure 5:
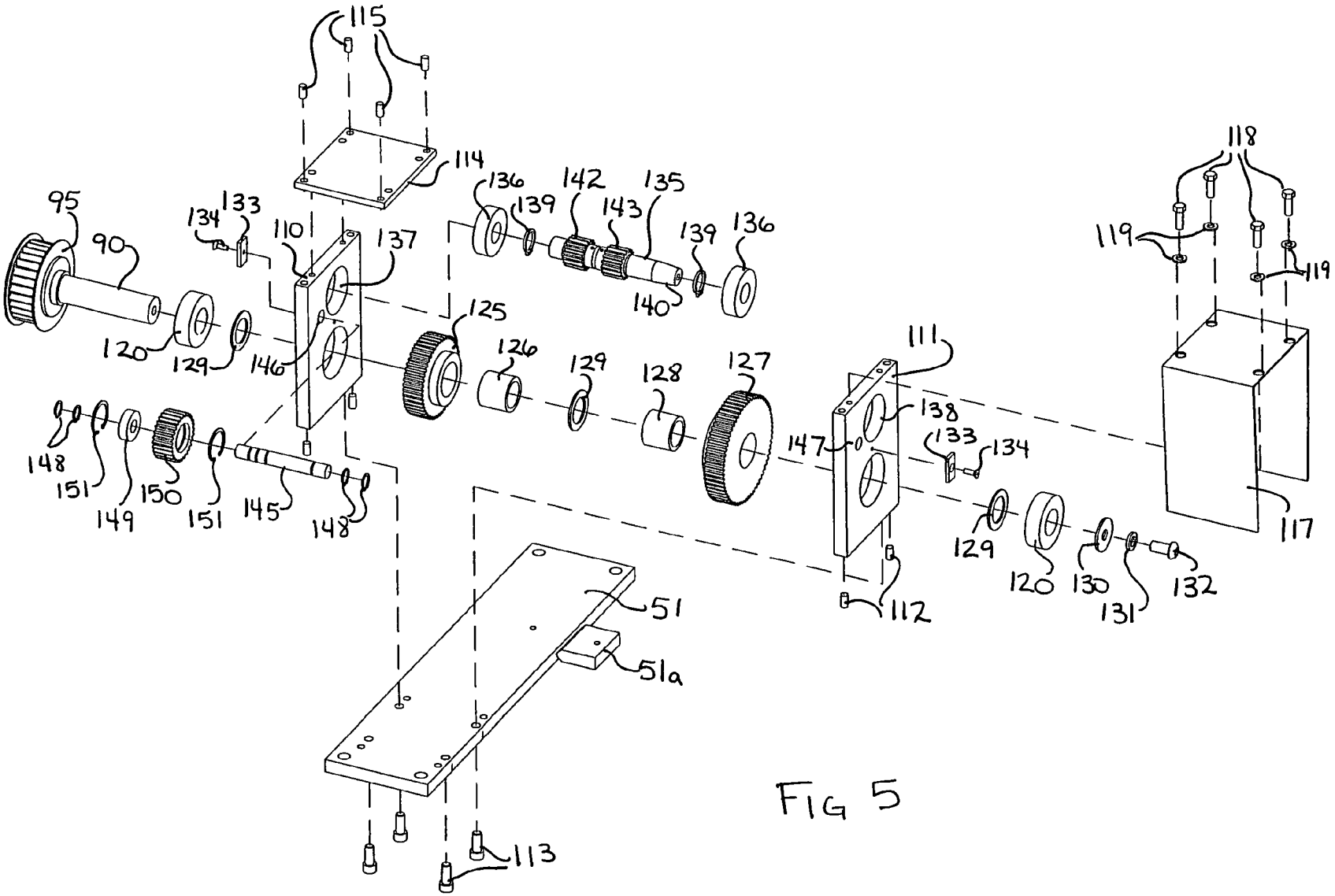
Figure 6:
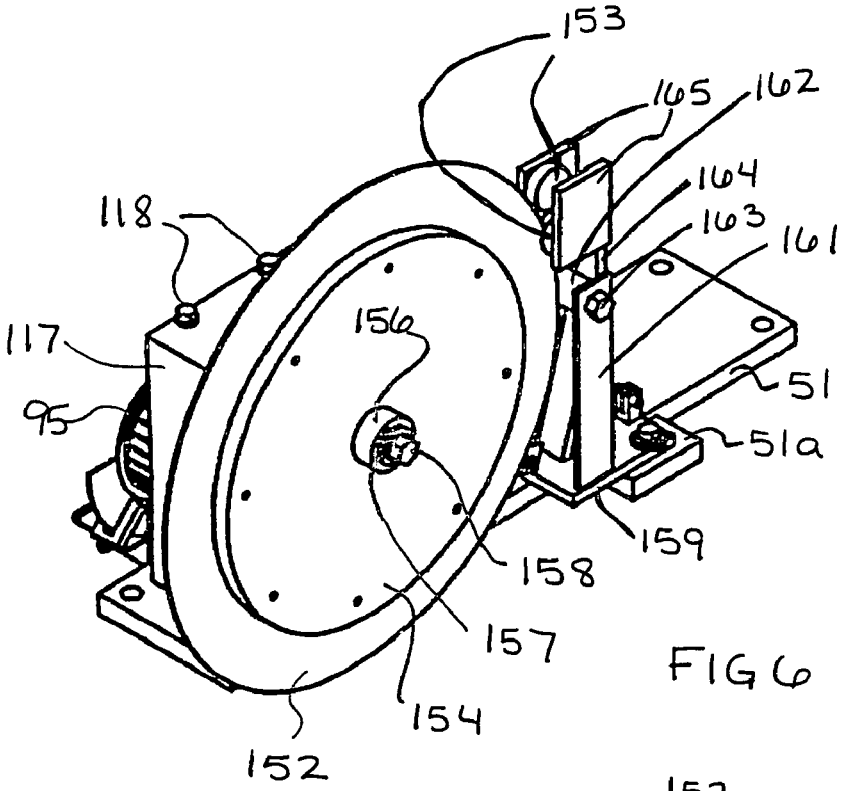
Figure 9:
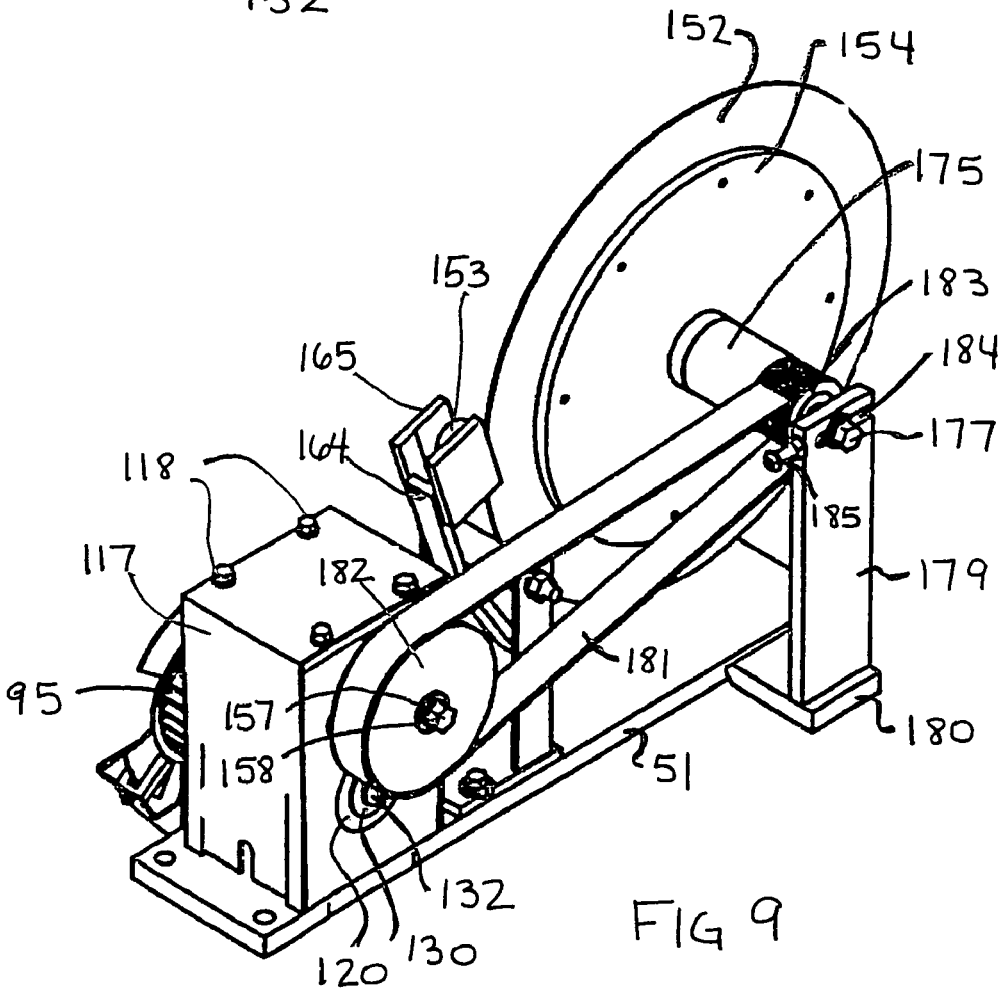
Figure 8:
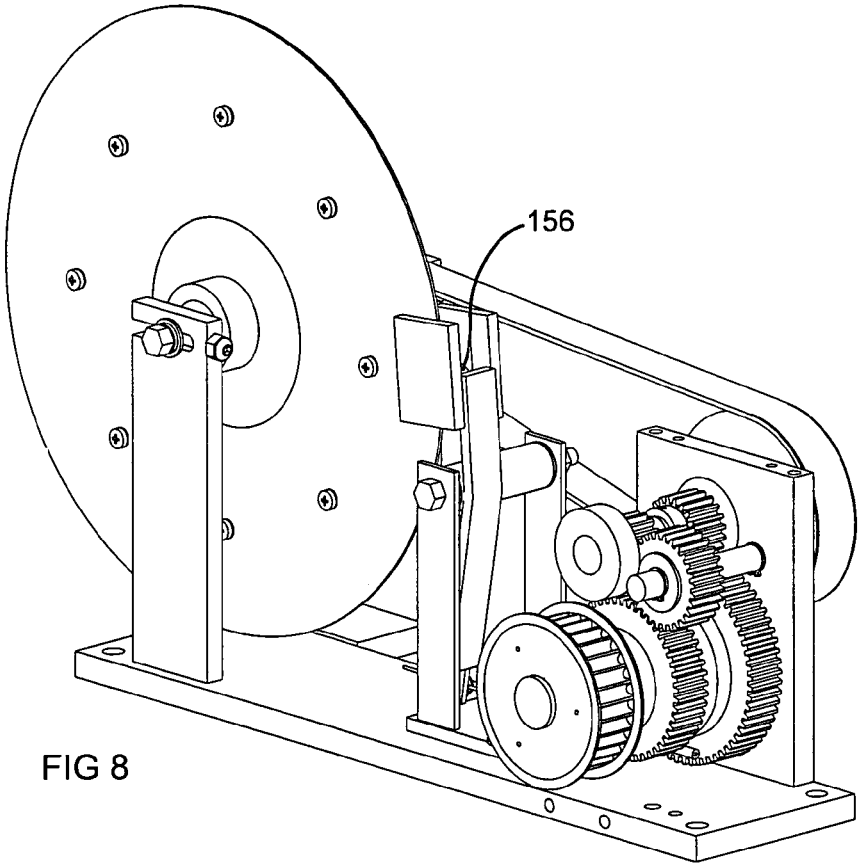
Figure 7:
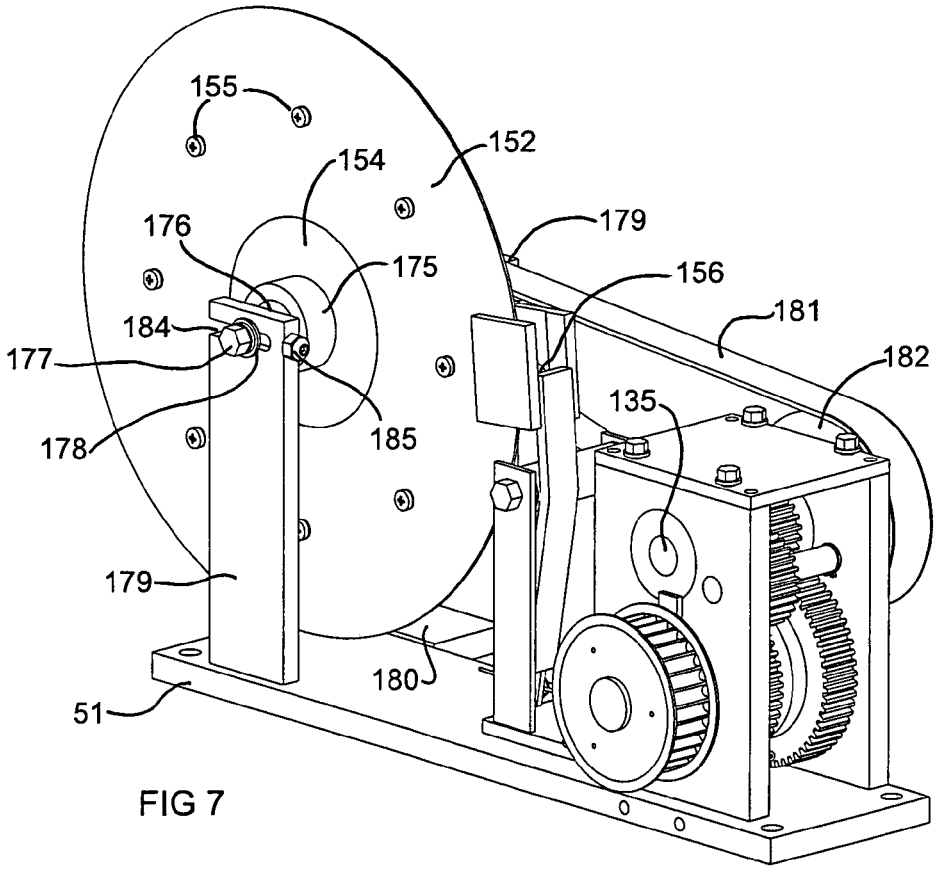
Figure 10:
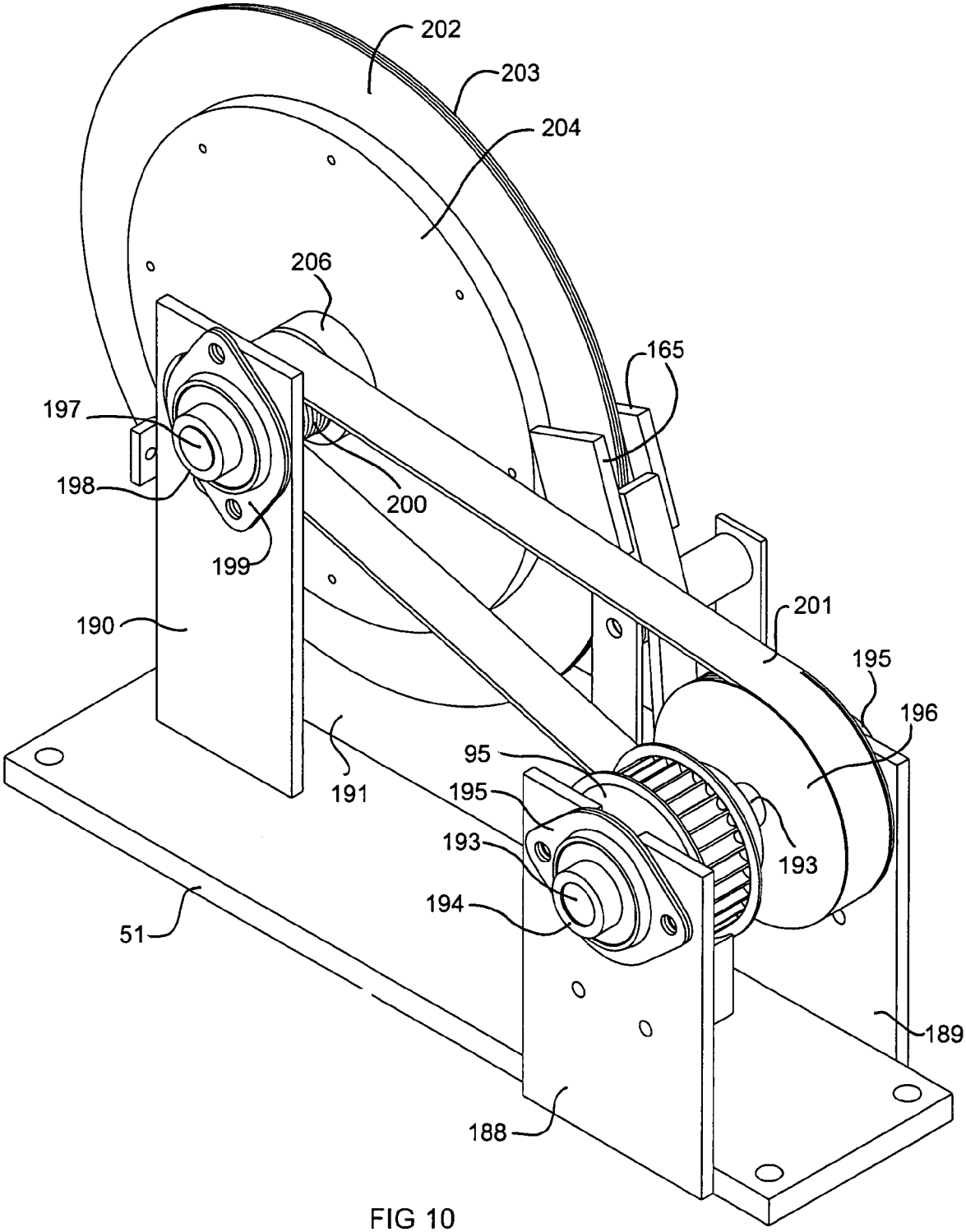

In the accompanying drawings, which show the best mode currently contemplated for carrying out the invention:

FIG. 1 is a front left side perspective view of an exercise machine of the invention;

FIG. 2, a perspective elevational view of the machine of FIG. 1 with the machine cover removed to show the interior construction of the machine;

FIG. 3, an enlarged perspective view of the transmission of the exercise machine of FIG. 2 with the transmission cover removed;

FIG. 4, a view similar to that of FIG. 3, but with the transmission top and one end plate also removed;

FIG. 5, an assembly view of the transmission of FIG. 2-4;

FIG. 6, a perspective view of the transmission and resistance device of FIGS. 2-4 from the opposite side shown in FIGS. 2-4;

FIG. 7, a view similar to that of FIG. 3 but showing a different coupling of the transmission output to the resistance device;

FIG. 8, a view similar to that of FIG. 7, but with the transmission top and one end plate removed;

FIG. 9, a perspective view of the transmission and resistance device of FIGS. 7 and 8 from the opposite side shown in FIGS. 7 and 8; and FIG. 10, a perspective view of a second embodiment of transmission and resistance device.

DETAILED DESCRIPTION OF THE ILLUSTRATED EMBODIMENTS

The invention can be used in connection with many types of exercise machines for use in exercising many different muscle groups and used by a user in many different positions. The invention will be described in detail with respect to a shoulder press and lat pull machine including a housing cover 20, FIG. 1, with seat portion 21 having a seat cushion 22 and a tower portion 23. Machine arms form handles 24 extending from slots 26 which slots extend substantially vertically along opposite sides of tower portion 23, only one of the opposite slots 26 being visible in FIG. 1. During use of the machine, a user sits on cushion 22 and grasps a handle 24 with each hand. The user then performs a shoulder press by pushing upwardly with his or her arms and hands to raise the handles 24 along slots 26, and when the shoulder press is completed to the desired extent, pulls his or her arms and hands downwardly to lower handles 24 along slots 26. When the lat pull is completed to the desired extent, the user will again push upwardly to repeat the sequence, and will continue to repeat the sequence the desired number of times. The user can perform the shoulder presses and lat pulls while sitting on the cushion 22 facing the tower portion 23, in which case the user will normally grasp handle hand grips 27, or while sitting on cushion 22 facing away from tower portion 23, in which case the user will normally grasp handle hand grips 28. However, a user can grasp handles 24 at any location along their length. A knob 29 to allow the user to adjust the resistance to arm movement, and various indicators or displays 30 can be mounted in or show through display portion 31 of the housing cover 20.

FIG. 2 shows the shoulder press and lat pull machine with the housing cover 20 removed. A frame is constructed with a lower longitudinal support member 35, forward and rear upright support members 36 and 37, respectively, and upper longitudinal support member 38. Lateral support members 40 and 41 extend from the rear of frame member 35, and with frame member 35, provide feet 42 which rest on and stabilize the machine on a supporting surface, such as a floor. Upper vertical support members 43, 44, and 45 extend upwardly from upper support member 38, and are joined at their tops by tower top member 46, to form a tower portion of the frame. The frame members can be welded together, or joined in any other suitable manner. A transmission 50 is mounted on longitudinal transmission support 51 secured to longitudinal support member 35 with spacers 52 and bolts 53.

A carriage track is formed by rods 60 and 61 secured by bolts 62 to supporting cross bar 63 mounted to upper support member 38 and secured by bolts 64 to top cross bar 65 secured to tower top member 46. A carriage formed by carriage side plates 70 and 71 secured together by spacers 72 and 73, such as by welding, is mounted on rods 60 and 61 by rollers 74 rotatably secured to carriage side plates 70 and 71 by axles 75 extending from the side plates and E-retaining rings 76. Handles 24 are secured to respective carriage side plates 70 and 71 by mounting brackets 80 secured to an end of each handle 24 and secured to carriage side plates 70 or 71 by bolts 81. Only the mounting of a handle 24 to carriage side plate 70 is shown in FIG. 2, but the opposite handle is similarly mounted to side plate 71. With the arrangement shown, the movement of handles 24 upwardly and downwardly cause movement of the carriage upwardly and downwardly along the carriage track. The carriage movement along the track guides movement of the handles during exercise. Rubber bumpers are preferably provided at the top and bottom of the track to absorb and lessen impact if the carriage hits the top or bottom end of the track. Top bumper 82 is visible in FIG. 2. The bottom bumper, not shown, is similarly positioned at the bottom of the track.

A bracket 83 secured to upper vertical support member 43 with mounting plate 84 mounts resistance adjustment assembly and knob 29 and display 30.

Resistance to movement of the carriage along the carriage track is provided by connection of the carriage through transmission 50 to a resistance device. Linear movement of the carriage along the track is converted to rotational movement at the input 90 of transmission 50. To accomplish this conversion of linear movement to rotational movement, a belt 91 is secured to the carriage by belt clamp plate 92 which is tightened by bolts 93 against carriage spacer 73 or a mating clamp plate, not shown, secured, such as by welding, to spacer 73, to tightly sandwich belt 91 therebetween. Belt 91 is sheaved around pulley 95 secured to transmission input 90 and around pulley 96 rotatably mounted by bolt 97 to pulley support 98 at the top of the tower portion of the frame. Pulley support 98 is bolted by bolt 99 to bracket 100 secured to vertical support member 43. Preferably a counter weight 101 is also secured to belt 91 to counterbalance the weight of the carriage and arms. Counterweight 101 may be secured to the belt along the length of the belt similarly to the securement of the carriage to the belt, or, preferably, to ease assembly of the machine, belt 91 can be formed of a length of belt material rather than an endless loop belt, with counterweight 101 secured between ends of belt 91 and functioning to connect the respective ends of belt 91. For this purpose, counterweight 101 includes belt clamps 102 at each end thereof. Each belt clamp 102 includes a clamp plate 103 secured, such as by welding, to an end of counterweight 101, and a mating belt clamp 104 tightened against clamp plate 103 by bolts 105 to tightly sandwich the end of the belt therebetween. As shown, to effectively counterbalance the carriage and arms, counterweight 101 is secured in the belt length between pulleys 95 and 96 opposite the length to which the carriage is secured. With the arrangement described, linear movement of the carriage by arms 24 back and forth along the carriage track causes movement of belt 91. Movement of belt 91 causes rotation of pulley 95 and transmission input 90. Each direction of movement of the arms and carriage moves the belt 91 in an opposite direction which causes pulley 95 and transmission input 90 to rotate in an opposite direction.

With the transmission illustrated in FIGS. 2-6, the transmission converts input rotational movement in opposition rotational directions into output rotation in a single direction. However, the transmission ratio is different for each rotational input direction. Thus, a given speed of rotation of the transmission input in one direction, for example the clockwise direction, will produce a certain speed of rotation of the transmission output in a certain direction, for example, the clockwise direction. Then rotation of the transmission input in the counter clockwise direction at the same speed will produce a different certain speed of rotation of the transmission output, but still in the clockwise direction. If the transmission output is connected to a resistance device that produces resistance to rotation of the transmission output that varies with the speed of rotation, different resistances will be produced for the same speed of rotation of the input but different directions of rotation of the input. The transmission will be in low gear in one direction and in high gear in the opposite direction. This means that the transmission input will be easier to turn, i.e., offer less resistance to turning, in one direction than it will in the other direction. The result is that handles 24 will be easier to move in one direction than in the other direction. This is exactly what is desired when the exercise machine offers resistance to movement in opposite directions. As indicated above, if a user is performing a shoulder press to lift handles 24 upwardly against a resistance, and then is performing a lat pull to pull the handles downwardly against a resistance, the user will normally be able to pull downwardly with greater strength than the user can push upwardly. Thus, to exercise effectively, the user will want more resistance to downward pull than to upward push. With the machine illustrated in FIGS. 1 and 2, the transmission is arranged so that the transmission input will rotate in the direction of easier rotation when a user pushes upwardly on handles 24, and will rotate in the direction of harder rotation when the handles 24 are being pulled downwardly. The result is that moving the handles upwardly will be easier than moving the handles downwardly. The different ratio of the transmission with respect to the direction of rotation will be built into the transmission. It has been found that for most exercises a generally universal difference in ratio can be found that works well for most users. For example, the difference in ratio between shoulder press and lat pull for most users will be about 3:4, meaning that the force required to perform the shoulder press will be about three quarters the force required to perform the lat pull. Thus, this ratio can be built into the transmission for the shoulder press-lat pull machine. Different ratios will be determined and used for exercise machines for different exercises.

The transmission includes end plates 110 and 111 secured to transmission support 51 by dowel pins 112 and screws 113, FIG. 5, and with top 114 positioned on the top of end plates 110 and 111 by dowel pins 115. A transmission cover 117 is secured over top 114 by screws 118 and lock washers 119 and encloses the sides of the transmission between the end plates. For illustrative purposes, FIG. 3 shows top 114 secured to the top of end plates 110 and 111 by screws 118 and lock washers 119 without the cover 117. This shows the transmission sides open so the internal parts can be seen. Input shaft 90 is journaled in radial bearings 120 mounted in receiving holes 121 and 122 in end plates 110 and 111. Spur gear 125 is secured to input shaft 90 through roller clutch bearing 126. A roller clutch bearing will turn with the shaft in one direction and slip with respect to the shaft in the other direction. Roller clutch bearing 126 operates to turn gear 125 when input shaft 90 turns in a counter clockwise direction. Input shaft 90 can turn in a clockwise direction without turning gear 125. Spur gear 127 is secured to input shaft 90 through roller clutch bearing 128. Roller clutch bearing 128 operates to turn gear 127 when input shaft 90 turns in a clockwise direction. Input shaft 90 can turn in a counter clockwise direction without turning gear 127. Satisfactory roller clutch bearings are available from Torrington Company in Torrington, Conn., under Part No. RCB-162117. Thrust bushings 129 are positioned between bearings 120, 126, and 128, and input shaft 90 is held in the transmission by washer fender 130, lock washer 131, and screw 132. Bearings 120 are held in the transmission by bearing retainers 133 secured by screws 134 to the outside of end plates 110 and 111.

Output shaft 135 is journaled in radial bearings 136 mounted in receiving holes 137 and 138 in end plates 110 and 111. Bearings 136 are also held in the transmission by bearing retainers 133 secured by screws 134 to the outside of end plates 110 and 111, while snap rings 139 hold output shaft 135 positioned in the transmission with output shaft end portion 140 extending from transmission end plate 111 for attachment to a resistance device. Gears 142 and 143 are secured to output shaft 135.

Idler shaft 145 is positioned in holes 146 and 147 in end plates 110 and 111 by snap rings 148, while bearing 149 with idler gear 150 is held in position on idler shaft 145 by snap rings 151. Idler gear 150 is freely rotatable on idler shaft 145 and engages both gear 125 on input shaft 90 and gear 142 on output shaft 135. Gear 127 on input shaft 90 directly engages gear 143 on output shaft 135.

In operation, when input shaft 90 is rotated in the clockwise direction it turns gear 127 in the clockwise direction which turns gear 143 and output shaft 135 in a counter clockwise direction. When input shaft 90 is rotated in a counter clockwise direction, it turns gear 125 in the counter clockwise direction which turns idler gear 150 in a clockwise direction. Idler gear 150 turning in a clockwise direction turns gear 142 and output shaft 135 in a counter clockwise direction. In this way, rotation of input shaft 90 in either direction results in rotation of output shaft 135 in the same direction. Also, the direct interengagement of gears 127 and 143 provide a different gear ratio between input and output shafts than the interengagement of gears 125 and 142 through idler gear 150.

In the embodiment of FIGS. 2-6, the resistance device connected to the transmission output is an eddy current resistance device which includes a copper disc 152 and adjustable magnets 153. Copper disc 152 is mounted on a hub 154 by screws 155. Hub 154 forms a flywheel and is secured directly to the output shaft end portion 140, and is held on the shaft by washer 157 and screw 158, FIG. 6. Hub 154 and copper disc 152 rotate together with the output shaft at the same speed of rotation as the output shaft. Further, hub 154 and copper disc 152 are supported by transmission output shaft end portion 140 along the side of longitudinal transmission support 51.

A magnet holder includes base 159 secured to transmission support 51 and support extension **51*a* by bolts 160 and has pivot support arms 161 secured to opposite edges thereof which extend upwardly therefrom, only one pivot support arm 161 being visible in FIGS. 3 and 4, the opposite support arm being visible in FIG. 6. Magnet arm pivot 162 is pivotally mounted between pivot support arms 161 by bolt 163, and is secured to magnet support arm 164 intermediate its length. Magnet mounting plates 165 are secured to the edges of the magnet support arm 164 at one end thereof and hold magnets 153. The opposite end of magnet support arm 164 is attached through bracket 167 and attachment pin 168 to an adjustment cable 169, the sheath 170 of which is secured to base 159 by sheath holder 171. With the assembly described, magnet support arm 164 is pivoted around bolt 163 to move magnets 153 to cover either more or less of copper disc 152. The more magnets 153 cover copper disc 152, the more eddy current generated in disc 152 as it rotates between magnets 153 and the more resistance to rotation is provided. Movement of the magnets in relation to disc 152 adjusts the amount of resistance to rotation provided. The position of the magnets is adjusted by movement of adjustment cable 169 with respect to adjustment cable sheath 170. This adjustment is done by the user by moving adjustment knob 29**. At any adjustment of the magnets, the resistance generated by the disc is also dependent on the speed of rotation of the disc. Thus, for any set position of the magnets with respect to the disc, the faster the disc is rotated, the more resistance is generated. This provides greater resistance to faster movement of the handles than to slower movement of the handles. Further, where the change in speed of rotation of the disc is greater for a given change in the speed of movement of the handles, the change in resistance for that change in speed of movement of the handle will also be greater.

For some types of exercises, it is desired to provide a speed of rotation for the copper disc greater than that usually obtained through direct connection of the disc to the output shaft of the transmission. In such situation, the copper disc can be coupled to the transmission output through a belt drive. FIGS. 7-9 show such an arrangement. The transmission shown in FIGS. 7-9 is identical to the transmission of FIGS. 2-6, so the same reference numbers are used. Rather than the hub 154 with copper disc 152 being secured directly to output shaft 135, a pulley 174 is secured to output shaft 135. Hub 154 with copper disc 152 secured thereto is secured to an elongate mounting tube 175 mounted on bearings for rotation on a rod 176 connected by bolts 177 and washers 178 between opposite supports 179, one of which is secured to transmission support 51 and the other of which is secured to transmission support extension 180. A belt 181 extends between pulley 182 secured to the output portion of output shaft 135 by washer 157 and screw 158 and a pulley 183, FIG. 9, secured to tube 175. Bolts 177 extend through slots 184 and adjustment screws 185 adjust the position of rod 176 in slots 184 in supports 179 to adjust the tension of belt 181. Pulley 182 will normally be larger than pulley 183 secured to tube 175 so that tube 175 with copper disc 152 will rotate at a faster rate than does transmission output shaft 135.

The magnet holder is also the same as that shown in FIGS. 2-6 so will allow a user to adjust the position of magnets 153 with respect to copper disc 152. The magnet holder, however, has a reverse orientation to work with the repositioned copper disc 152.

FIG. 10 shows a different embodiment of transmission and resistance device for achieving the different resistances for different directions of rotational movement. Here, rather than converting the opposite directions of input rotation to the same direction of output rotation, the different directions of rotation of the input produces different directions of rotation of the output. However, rather than the resistance device having a single resistance producing element, two resistance producing elements are included in the resistance device, one resistance element is operated by rotation of the output shaft in one direction and the other is operated by rotation of the output shaft in the opposite direction. In this way, when the resistance elements include rotating discs which also form flywheels to maintain smooth rotation and smooth operation of the machine, the direction of the rotation of the discs does not change, but remain the same during operation of the machine. The flywheel function of the discs will keep the respective discs rotating in their respective directions during rotation of the input and output shafts in the opposite, non-powering direction of rotation of the input. Thus, rather than mounting the gears 125 and 127 in the transmission of FIGS. 3-9 through roller clutch bearings, hubs and copper discs can be similarly mounted to the output shaft so that rotation of the output shaft in one direction will impart rotational movement to one hub in one rotational direction and rotation of the output shaft in the opposite direction will impart rotational movement to a second hub in that same opposite rotational direction. In this embodiment, the gear ratio between input shaft rotation in one direction will be the same as the gear ration for the other direction. Here, the resistance of the two different resistance devices can be set to be different. Thus, if an eddy current resistance device as described is used, since the distance of the magnets from the copper disc, or the positioning of the magnets with respect to the copper disc, change the resistance of the disc to rotation of the disc, the magnet positioning is adjusted differently for each resistance device to provide the difference in resistance offered by each device and thus the resistance offered for each direction of rotation. While it is currently preferred to preset the magnet positions to create a set ratio between the resistance to rotation offered in each direction of travel, with the use of the two resistance devices, the machine can offer user adjustable resistance in each direction of travel, rather than just a preset ratio of the different resistances.

Referring to FIG. 10, the transmission includes end plates 188 and 189 secured, such as by welding, to transmission support 51, and support arms 190 and 191 also secured, such as by welding, to transmission support 51. A transmission input shaft 193 journaled in bearings 194 in bearing supports 195 extends between end plates 188 and 189. Input pulley 95, as previously described, is secured to input shaft 193 as is transmission pulley 196. An output shaft 197 journaled in bearings 198 in bearing supports 199 (only bearing 198 and bearing support 199 mounted on support arm 190 is visible, bearing 198 and bearing support 199 mounted on support arm 191 being hidden) extends between support arms 190 and 191. Pulley 200 is secured to output shaft 197. Pulley belt 201 is sheaved over pulleys 196 and 200 so that rotation of input pulley 95, input shaft 193, and pulley 196 cause a similar rotation of output shaft 197. Thus, input rotation in one direction causes rotation of output shaft 197 in one direction and input rotation in the opposite direction causes rotation of the output shaft in the opposite direction. Because pulley 196 is larger than pulley 200, the output shaft 197 will rotate at a faster rate than the input shaft does.

Two resistance elements made up of copper discs 202 and 203, each mounted on a separate hub, only hub 204 mounting copper disc 202 being shown, are separately coupled to output shaft 197 through mounting tubes secured in the hubs and roller clutch bearings between the mounting tubes and output shaft 197. Mounting tube 206 in hub 204 is shown in FIG. 10, but the roller clutch bearing in tube 206 is not visible. With this arrangement, when output shaft 197 rotates in one direction, roller clutch bearing in mounting tube 206, mounting tube 206, hub 204, and attached copper disc 202 will rotate with output shaft 197 in that direction. With hub 204 forming a flywheel and with the coupling to the output shaft being through the roller clutch bearing, once rotation of hub 204 and disc 202 is started, rotation will tend to continue for a short time even when rotation of the output shaft 197 stops or reverses direction of rotation. When rotation of output shaft 197 reverses direction, the other hub with attached disc 203, which is coupled to the output shaft 197 through the other roller clutch bearing, will rotate with shaft 197 in the reverse direction. Again, with the hub forming a flywheel, once rotation of the hub and attached disc 203 is started, rotation will tend to continue for a short time even when rotation of the output shaft 197 stops or reverses direction of rotation. Thus, during operation of the exercise machine with a user moving handles back and forth, discs 202 and 203 will rotate in opposite directions.

Magnets, not shown, are mounted on magnet mounting plates 165 as previously described. However, in this embodiment, rather than a single disc between two magnets, the two discs 202 and 203 are positioned between the magnets. As indicated, the positioning of the magnets with respect to the discs will determine the resistance to rotation generated by the discs. The greater the magnetic field applied by a magnet to a disc, the more resistance to rotation will be generated. In order to provide different resistances to rotation by each of the discs 202 and 203, the magnets are arranged to provide a greater magnetic field to one disc than to the other. This can be done by positioning one magnet closer to one of the discs than the other magnet is positioned to the other disc, or by positioning one magnet in its magnet holder to intersect more of its adjacent disc than the other magnet. In the embodiment of FIG. 10, adjustment of the magnets in the manner previously described to change the resistance to rotation, will adjust both magnets simultaneously to maintain the preset ratio of more magnetic field on one disc than the other.

While a carriage has been shown as a means for coupling the handles to the transmission input and converting movement of the handles into rotational movement applied to the input of the transmission, and the carriage track has been shown in a vertical orientation, it should be realized that any orientation of the carriage and tracks can be used depending upon the type of machine with which the invention is used and that various other ways of coupling the handles to the transmission input can be used, again, depending upon the type of machine with which the invention is used. The important thing is to couple the handles so that movement of the handles creates rotational movement of the transmission input and so that resistance to rotational movement of the transmission input is transmitted from the transmission input to the handles to resist movement of the handles. Further, while the handles are shown as being held and moved by the hands of a user, as used herein, the handles can be contacted and move by other parts of the user's body such as by the user's feet, legs, or arms, and the part of the user's body contacting and moving the handles can be secured to the handles, such as by straps.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

We claim:

1. Exercise apparatus comprising:

a frame;

movement means mounted on the frame and moveable by a user in opposite directions;

resistance means;

a transmission for coupling input rotational movement of a transmission input to the resistance means in a manner to provide a different resistance to rotation of the transmission input depending upon the direction of rotation of the transmission input, the resistance means resisting rotational movement of the transmission input in one rotational direction to a greater extent than it resists rotational movement of the transmission input in the opposite rotational direction; and means coupling the movement means to the transmission input and converting movement of the movement means into rotational movement applied to the input of the transmission, movement of the movement means in one direction creating rotational movement of the transmission input in one direction and movement of the movement means in the opposite direction creating rotational movement of the transmission input in the opposite direction, said movement means including a carriage mounted on a track for movement back and forth along the track, the movement means secured to and extending from the carriage; and a belt secured to the carriage and to the transmission input whereby movement of the carriage causes movement of the belt which, in turn, causes rotational movement of the transmission input.

2. Exercise apparatus according to claim 1, wherein the transmission converts input rotational movement of the transmission input in opposite rotational directions into output rotational movement of a transmission output in a single rotational direction, wherein the transmission has a gear ratio between the transmission input and the transmission output, the gear ratio between the transmission input and the transmission output being different for the different directions of input rotation.

3. Exercise apparatus according to claim 2, wherein the transmission output is coupled to the resistance means.

4. Exercise apparatus according to claim 3, wherein the resistance means is an eddy current generating resistance means.

5. Exercise apparatus according to claim 4, wherein the eddy current generating resistance means includes a disc which rotates between magnets.

6. Exercise apparatus according to claim 5, wherein the positioning of the magnets with respect to the disc is adjustable to adjust resistance to rotation generated by the disc.

7. Exercise apparatus according to claim 6, wherein the disc includes a hub which functions as a flywheel.

8. Exercise apparatus according to claim 7, wherein the disc is mounted directly to the transmission output.

9. Exercise apparatus according to claim 7, wherein the disc is coupled to the transmission output by a belt drive.

10. Exercise apparatus according to claim 2, wherein the transmission includes an input shaft, an output shaft, and an idler shaft; a first gear mounted on the input shaft to rotate with the input shaft when the input shaft rotates in one direction; a second gear mounted on the input shaft to rotate with the input shaft when the input shaft rotates in the opposite direction; an idler gear mounted on the idler shaft and meshing with the first gear; a first output gear secured to the output shaft and meshing with the idler gear; and a second output gear secured to the output shaft and meshing with the second gear.

11. Exercise apparatus according to claim 1, wherein the resistance means includes two resistance elements, and wherein the transmission connects the transmission input to one of the two resistance elements depending upon the direction of rotation of the transmission input, one resistance element resisting rotational movement of the transmission input in one rotational direction and the other of the resistance elements resisting rotation of the transmission input in the opposite rotational direction.

12. Exercise apparatus according to claim 11, wherein the transmission includes a shaft; a first coupling means mounted on the shaft and coupled to one of the resistance elements to rotate with the shaft when the shaft rotates in one direction; and a second coupling means mounted on the shaft to rotate with the shaft when the shaft rotates in the opposite direction.

13. Exercise apparatus comprising:

a frame;

movement means mounted on the frame and moveable by a user in opposite directions;

resistance means including two resistance elements each including a disc which rotates between magnets;

a transmission for coupling input rotational movement of a transmission input to the resistance means in a manner to provide a different resistance to rotation of the transmission input depending upon the direction of rotation of the transmission input, the resistance means resisting rotational movement of the transmission input in one rotational direction to a greater extent than it resists rotational movement of the transmission input in the opposite rotational direction, said transmission including an output shaft, one of the discs being coupled to the output shaft to rotate with the output shaft when the output shaft rotates in one direction; and the other disc being coupled to the output shaft to rotate with the output shaft when the output shaft rotates in the opposite direction, one of the two resistance elements resisting rotational movement of the transmission input in one rotational direction and the other of the resistance elements resisting rotational movement of the transmission input in the opposite rotational direction; and means coupling the movement means to the transmission input and converting movement of the movement means into rotational movement applied to the input of the transmission, movement of the movement means in one direction creating rotational movement of the transmission input in one direction and movement of the movement means in the opposite direction creating rotational movement of the transmission input in the opposite direction.

14. Exercise apparatus according to claim 13, wherein the positioning of the magnets with respect to the disc determines the resistance to rotation generated by the disc, and wherein the magnets are positioned differently with respect to each disc so that each disc provides a different resistance to rotation.

15. Exercise apparatus according to claim 14, wherein the positions of the magnets with respect to the discs is adjustable to adjust resistance to rotation generated by the discs and the adjustment of the positions of the magnets with respect to both discs occurs simultaneously to maintain the relative positions of the magnets with respect to each disc in a predetermined relationship to maintain a predetermined ratio of difference in resistance to rotation by each disc.

16. Exercise apparatus according to claim 13, wherein each disc includes a hub which functions as a flywheel.

17. Exercise apparatus comprising:

a frame;

handles mounted on the frame and moveable by a user in opposite directions;

a resistance device having two resistance elements;

a transmission for connecting input rotational movement of a transmission input to one of the two resistance elements depending upon the direction of rotation of the transmission input, one resistance element resisting rotational movement of the transmission input in one rotational direction and the other of the resistance elements resisting rotation of the transmission input in the opposite rotational direction; and a coupling coupling the handles to the transmission input and converting movement of the handles into rotational movement applied to the input of the transmission, movement of the handles in one direction creating rotational movement of the transmission input in one direction and movement of the handles in the opposite direction creating rotational movement of the transmission input in the opposite direction.

18. Exercise apparatus according to claim 17, wherein the resistance device is an eddy current generating resistance device including two resistance elements each include a disc which rotates between magnets; and wherein the transmission includes a shaft, one of the discs being coupled to the shaft to rotate with the shaft when the shaft rotates in one direction; and the other disc being coupled to the shaft to rotate with the shaft when the shaft rotates in the opposite direction.

19. Exercise apparatus according to claim 18, wherein the positioning of the magnets with respect to the disc determines the resistance to rotation generated by the disc, and wherein the magnets are positioned differently with respect to each disc so that each disc provides a different resistance to rotation.

20. Exercise apparatus according to claim 19, wherein the positions of the magnets with respect to the discs is adjustable to adjust resistance to rotation generated by the discs and the adjustment of the positions of the magnets with respect to both discs occurs simultaneously to maintain the relative positions of the magnets with respect to each disc in a predetermined relationship to maintain a predetermined ratio of difference in resistance to rotation by each disc.

21. Exercise apparatus according to claim 17, wherein each disc includes a hub which functions as a flywheel.

22. Exercise apparatus according to claim 11, wherein the two resistance elements each include a disc which rotates between magnets; and wherein the transmission includes a shaft, one of the discs being coupled to the shaft to rotate with the shaft when the shaft rotates in one direction; and the other disc being coupled to the shaft to rotate with the shaft when the shaft rotates in the opposite direction.

23. Exercise apparatus according to claim 13, wherein the positioning of the magnets with respect to the disc determines the resistance to rotation generated by the disc, and wherein the magnets are positioned differently with respect to each disc so that each disc provides a different resistance to rotation.

24. Exercise apparatus according to claim 14, wherein the positions of the magnets with respect to the discs is adjustable to adjust resistance to rotation generated by the discs and the adjustment of the positions of the magnets with respect to both discs occurs simultaneously to maintain the relative positions of the magnets with respect to each disc in a predetermined relationship to maintain a predetermined ratio of difference in resistance to rotation by each disc.

25. Exercise apparatus according to claim 6, wherein each disc includes a hub which functions as a flywheel.

* * * * *